United States Patent [19]

Frick et al.

[11] Patent Number: 4,802,636

[45] Date of Patent: Feb. 7, 1989

[54] METHOD AND APPARATUS FOR LEVEL WINDING ELASTOMERIC RIBBON

[75] Inventors: Richard H. Frick, Neenah; Hugo L. Kons; Marion C. Morris, both of Appleton, all of Wis.

[73] Assignee: Kimberly-Clark Corporation, Neenah, Wis.

[21] Appl. No.: 342,965

[22] Filed: Jan. 26, 1982

[51] Int. Cl.[4] ..... B65H 18/08

[52] U.S. Cl. ..... 242/67.1 R; 242/DIG. 2; 242/158 R; 242/158.4 R

[58] Field of Search ..... 242/67.1 R, DIG. 2, 242/67.5, 65, 1, 166, 158 R, 158.4 R, 43 R, 159, 55, 168, 169, 171

[56] References Cited

U.S. PATENT DOCUMENTS

| | | | |
|---|---|---|---|
| 1,795,506 | 3/1931 | Reiners et al. | 242/65 |
| 2,135,668 | 11/1938 | Judelshon | 242/67.1 R X |
| 2,475,895 | 7/1949 | Hill | 242/43 X |
| 2,683,917 | 7/1954 | Furst | 242/65 X |
| 2,712,804 | 7/1955 | Cone | 242/169 |
| 3,023,888 | 3/1962 | Scott | 242/1 |
| 3,877,655 | 4/1975 | Cardinal et al. | 242/67.1 R |
| 3,997,122 | 12/1976 | Helfand et al. | 242/67.1 R X |
| 4,150,801 | 4/1979 | Ikegami et al. | 242/158 R |
| 4,645,135 | 2/1987 | Morris et al. | 242/67.1 R |

*Primary Examiner*—Harvey C. Hornsby
*Assistant Examiner*—Scott J. Haugland
*Attorney, Agent, or Firm*—John L. Chiatalas

[57] ABSTRACT

An apparatus and method for winding a thin elastomeric ribbon having a low coefficient to friction onto a reel is disclosed. The ribbon is fed onto a rotating reel while being traversed along the axial length of the reel to distribute the ribbon onto the reel. The nodes typically formed on the axial ends of ribbon rolls wound in this manner are eliminated by reversing the traversed direction of the ribbon short of the end cap of the reel to form a gap between the axial end of the ribbon roll and the end cap and then shifting the ribbon turns into the gap to thereby collapse the node.

8 Claims, 2 Drawing Sheets

METHOD AND APPARATUS FOR LEVEL WINDING ELASTOMERIC RIBBON

This invention relates to a method and apparatus for winding elastomeric ribbon such as natural rubber ribbon about a reel.

BACKGROUND OF THE INVENTION

Due to a number of advantageous characteristics, natural rubber ribbon has been commonly used in the clothing industry for some time to provide elasticized areas in garments. Some of the advantages of natural rubber include high elongation before the yield point is reached and relatively low growth. The high elongation ability permits a large amount of contraction where desired and the low growth results in the ability of the rubber to consistently retract to its original length. Natural rubber also has relatively low aging properties so that the elasticity in the garment lasts for a considerable length of time. In addition, natural rubber can be provided in very thin flat ribbon form to make it relatively invisible when enclosed between garment layers.

There are disadvantages, however, in the use of natural rubber ribbon in the garment manufacturing process. Natural rubber is typically provided by vendors in festooned form in cartons or loose in the cartons. Knots and tangles are usually present in the ribbon when provided in this fashion so that when the ribbon is fed into a high speed garment fabricating machine, the knots and tangles dispense from the carton and result in breakage or other problems causing shutdown of the machine. Moreover, the rubber is not provided in the cartons in lengths permitting sufficiently long machine running time at the high machine speeds commonly used. Finally, due to the sticking of the natural rubber to itself in the carton, it is coated with a friction reducing material such as talcum powder which alleviates the sticking problem. However, the use of the powder causes the new problem of difficulty in handling the ribbon due to its slipperiness.

SUMMARY OF THE INVENTION

According to the invention, thin elastomeric ribbon is wound onto a large reel from the festooned carton supply source to provide a large lineal footage of ribbon for the high speed garment fabricating machines. In the event of tangling and twisting problems from the supply, only the reel winding equipment need be stopped rather than an entire garment machine. The problem of tangling on the reel as a consequence of node build-up and collapsing and loosening of the ribbon is eliminated by feeding the ribbon onto the rotatably driven reel between the end caps of the reel, reversibly guiding the ribbon parallel to the axial length of the reel to form a ribbon roll and distribute the ribbon on the roll along the axial length of the reel, reverse the direction of distributing movement of the ribbon before the ribbon engages each end cap to form a gap between the end cap and the ribbon turns as wound, and collapse the ribbon turns adjacent the gap into the gap. The collapsing of the ribbon turns adjacent the gap thus eliminates the node build-up in that area to prevent the winding and tangling problems resulting from the node. In addition, a rotating roll may be pressed against the node to assist in its collapse and the roll may be also positioned opposite the gap to ensure that the collapsed ribbon turns are contained within the gap.

DESCRIPTION OF THE DRAWINGS

The apparatus and method of the invention will be more readily understood by reference to the accompanying drawings, in which.

DETAILED DESCRIPTION OF THE INVENTION

Figure 1:
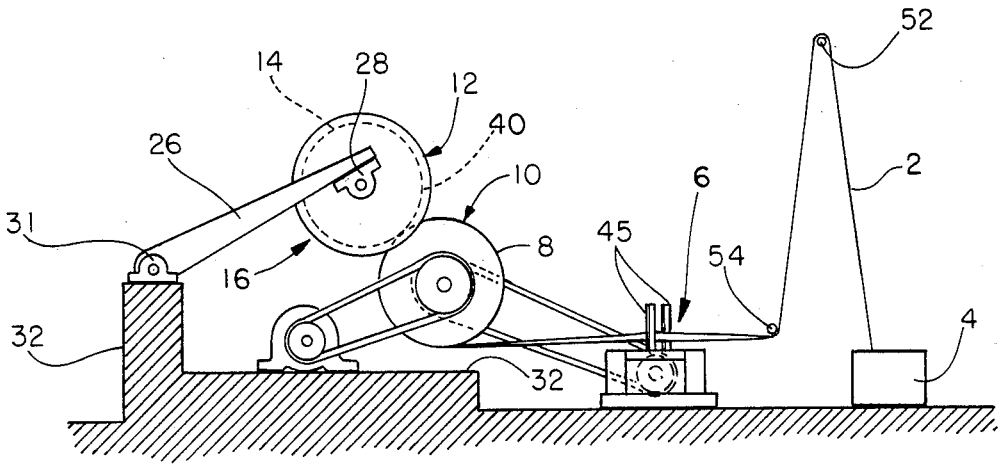
FIG. 1 is a side elevational view of apparatus used in the invention.
Figure 2:
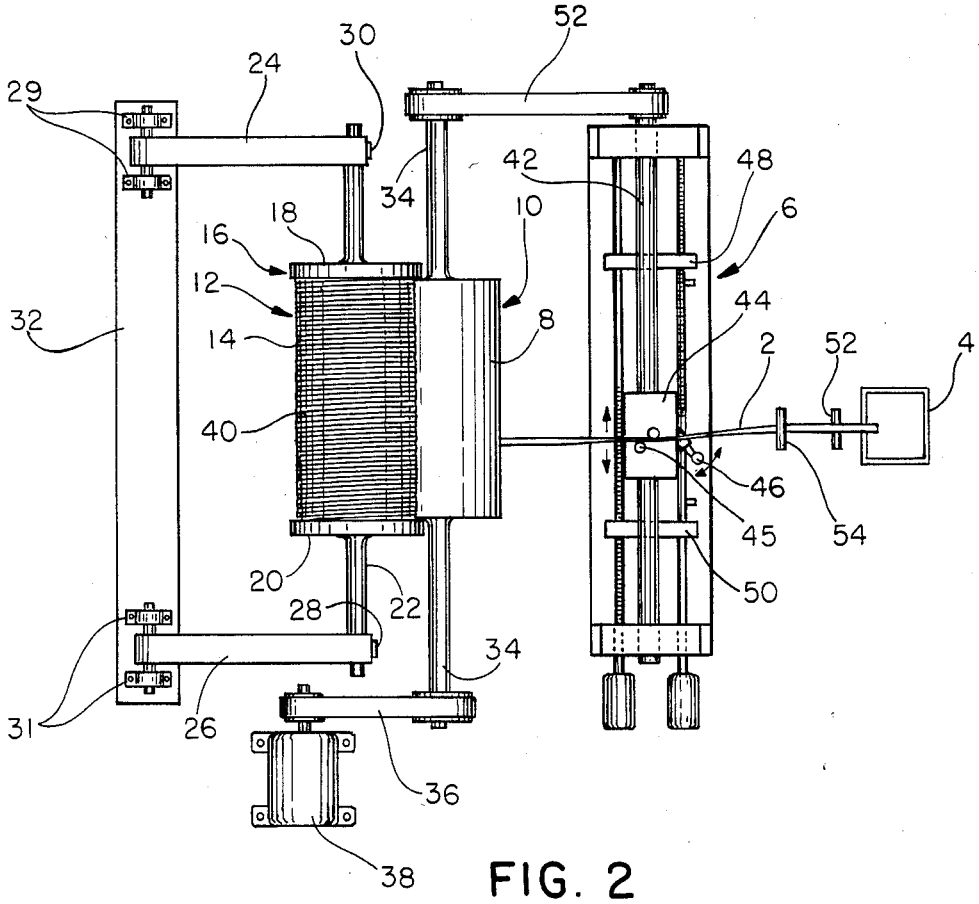
FIG. 2 is a plan view of the apparatus shown in FIG. 1.

Wih reference to FIGS. 1 and 2, there is shown an elastomeric ribbon 2 being drawn from a carton 4 and fed toward the ribbon winding apparatus. Ribbon 2 is preferably of a natural rubber or other elastomeric material suitable for use in elasticizing garments and typically has a thin flat cross-sectional shape which will minimize its visibility in a garment. To minimize sticking to itself in the supply carton 4, the ribbon 2 will have a low tack level and, if the ribbon is natural rubber, it will typically be coated with a tack reducing material such as talcum powder. As the ribbon 2 is drawn from the carton 4 it is fed over a guide rod 52 at a substantial height above the carton to assist in removing tangles from the ribbon. The ribbon 2 is then fed under a guide rod 54 which is positioned such that the ribbon 2 follows a substantially horizontal path toward traversing means 6 and into engagement with the surface 8 of a drive roll 10. From the drive roll 10, the ribbon moves on to ribbon roll 12. The ribbon roll 12 comprises a plurality of wound ribbon turns 14 and is carried on a reel 16 having a rotatable shaft 22 and a pair of spaced apart end caps 18 and 20 mounted on the shaft 22. The rotatable shaft 22 is rotatably mounted at its opposite ends on cantilever arms 24 and 26 by pillow blocks 28 and 30, respectively. The cantilever arms 24 and 26, in turn, are each pivotally mounted by pillow block pairs 29 and 31 on the support means 32 for the ribbon winding apparatus.

The surface 8 of drive roll 10 may be of a rubbery material to enhance the friction between the surface 8 and the ribbon 2 to assist in a consistent traversing movement of the ribbon 2 and provide an even surface with minimum noding on the ribbon roll 12. The drive roll 10 includes a shaft 34 rotatably driven by a motor 38 via belt and pulley means 36. As can be seen in FIGS. 1 and 2, due to the pivotal mounting of the reel 16 on cantilever arms 24 and 26, the ribbon roll 12 on the reel 16 is positioned against the drive roll 10 so that the drive roll 10 applies pressure or force to the ribbon roll 12 to thereby rotate the reel 16 and ribbon roll 12 as the drive roll 10 is rotated by the motor 38. The length of the drive roll 10 ls such that it fits between the spaced apart end caps 18 and 20 to bear against the cylindrical surface 40 of the ribbon roll 12.

The traversing means 6 includes a shaft 42 driving a reversible guide means 44 having a pair of guide fingers 45 which travels in directions parallel to the axes of the reel 16 and drive roll 10. The guide means 44 is reversed in its direction of travel when reversing lever 46 engages adjustable stop means 48 or 50. The traversing means 6 is driven by motor 38 via belt and pulley means 52 connected between the shaft 42 of the traversing means 6 and the shaft 34 of the drive roll 10.

As previously discussed, the ribbon 2 is fed from the festooned carton 4 past the guide rods 52 and 54. Guide rod 54 is positioned such that the ribbon 2 will be fed along a substantially horizontal path between the guide fingers 45 of the traversing means 6 into engagement with the drive roll 10. The guide rods 52 and 54 are of an air bearing type, well known in the prior art, which may be adjusted to control the amount of tension on the ribbon 2. The importance of maintaining tension on the ribbon 2 is to hold it in tight engagement with the drive roll 10 to assist in consistent traversing movement of ribbon 2 as it is wound on to the reel 16. With natural rubber ribbon 0.25 inches wide by 7 mils thick, supplied by Easthampton Rubber Company, it has been found that an elongation of at least 5% of the unelongated length of the ribbon is required to provide the desired tension.

The speed of the traversing means 6 is set such that the wound turns 14 on the ribbon roll 12 have at least a slight overlap in each layer. If at least some overlap is not maintained there is a tendency for adjacent turns in a layer to separate to result in a small gap which may result in the formation of a node at the location of the gap. At the end of the traversing of the ribbon 2 in one direction, upon reversal of the guide means 44, there is a lag in the traversing reversal of the ribbon 2 so that an extra wound turn 14 or a portion of such turn will be wound onto the end of the ribbon roll 12. The occurrence of this extra layering of turns 14 at the end of the ribbon roll 12 will cause a node to occur and the presence of the node will exacerbate its tendency to increase. The build-up of nodes interferes with the level winding of the ribbon roll 12 and ultimately will cause looseness and tangling of the ribbon 2 to defeat the purpose of winding the ribbon roll 12.

Figure 3:
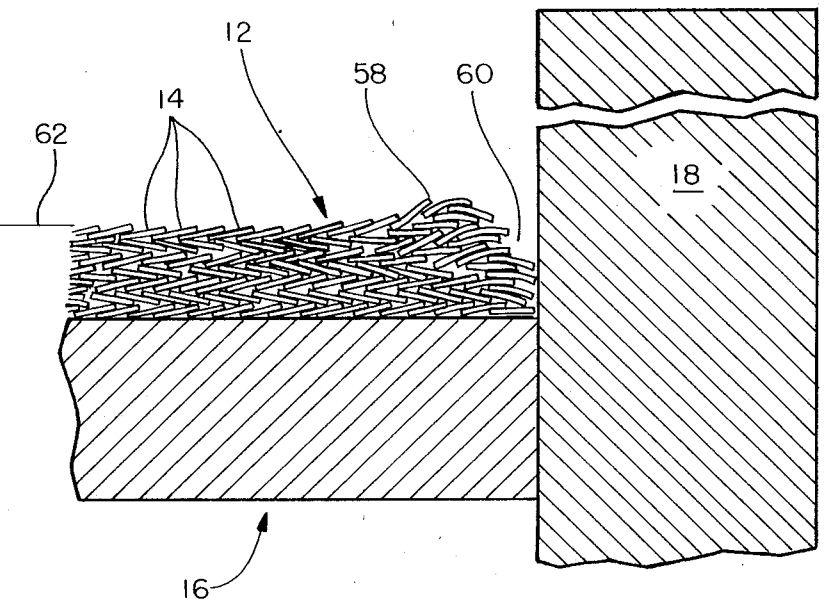
FIG. 3 is a cross-sectional view of a reel and ribbon roll showing a gap between the reel end cap and ribbon node prior to collapse of the node.
Figure 4:
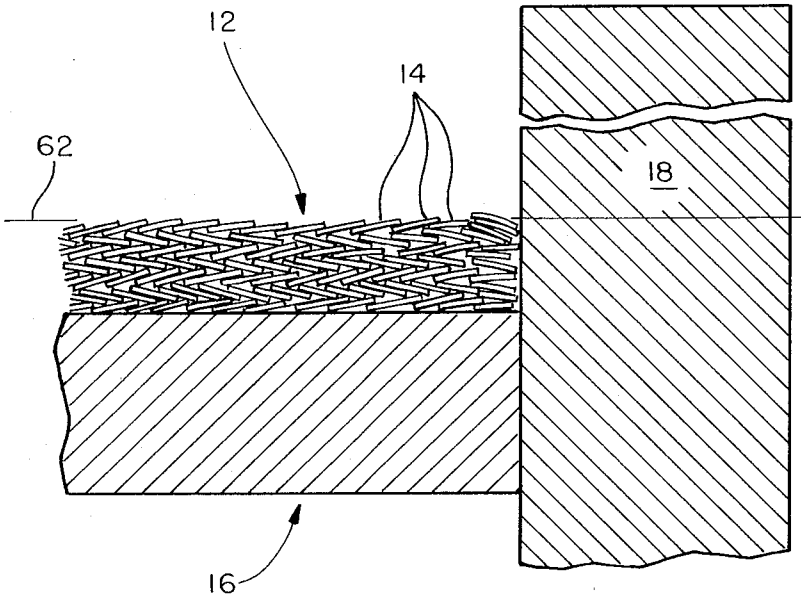
FIG. 4 is a cross-sectional view of the reel and ribbon roll of FIG. 3 illustrating the ribbon roll after the collapse of the node.

In order to prevent the node build-up at the opposite ends of the wound ribbon roll 12 from interfering with the winding of the roll 12, the stop means 48 and 50 of the traversing means 6 are set such that the guide means 44 will reverse its movement and that of the traversing winding direction of the ribbon 2 at a position adjacent to but spaced from the end caps 18 and 20 of the reel 16. With reference to FIG. 3, a gap 60 is thus formed between the end cap 18 and the node 58 of the wound roll 12. Note that the FIG. 3 illustrates only the gap formed between the wound ribbon roll 12 and the end cap 18, however, an identical gap will be formed at the opposite end of the wound roll 12 adjacent end cap 20 and therefore only the gap 60 adjacent to end cap 18 will be discussed herein. As the node 58 builds up to a radius exceeding the radius of the surface 62 of the roll 12 axially inward of the node 58, the node 58 becomes very unstable due to lack of axial end support at the gap 60 and due to the very low level of adherence of the individual turns 14 to each other in the node 58. The result is that the node 58 collapses such that the turns 14 comprising the node shift axially outward toward the gap 60 and those turns 14 most adjacent the gap 60 slip into and fill the gap 60. In FIG. 4 is shown the roll 12 after the node 58 has collapsed and the turns 14 of the node 58 have slipped into the gap 60 to fill it. The node 58 has disappeared so that the surface of the roll 12 at the area formerly occupied by the node is at the same level as the surface 62 of the roll 12. It is desirable, of course, that the node 58 collapse to the level of the surface 62 and not above it or below it each time the node 58 collapses to minimize the noding problems previously discussed. The extent to which the node 58 collapses is determined by the cross-sectional configuration of the ribbon 2, the extent of adherence of each ribbon turn 14 to adjacent turns 14, the height in a radially outward direction to which the node 58 extends, and the width of the gap 60. In addition, the radial extent to which the node 58 builds can be affected by the amount of force applied to the node 58 by the drive roll 10 which bears against the node 58. For an elastomeric ribbon 2 having particular cross-sectional dimensions and cohesiveness and a drive roll 10 applying a predetermined amount of force to the node 58 formed by the ribbon 2, the gap 60 should be set by adjustment of the stop means 48 and 50 so that, each time the node 58 collapses, it will collapse to a level such that the surface of the roll 12 adjacent the end cap 18 has substantially the same radius as the surface 62 of the roll 12 axially inward of the node 58. It has been found that, when winding the talcum coated natural rubber ribbon obtained from the Easthampton Rubber Company having a width of 0.25 inches and a thickness of 7 mils and the drive roll 10 applies a force of 5 to 85 lbs. to the node 58, the width of the gap 60 should be approximately 1/32 inch. With this type of ribbon, gap width, and drive roll force, the ribbon turns 14 of the node 58 collapsed about once every ten turns. This resulted in a ribbon roll 12 having a very level surface which was subsequently successfully unwound at relatively high speed in conjunction with the operation of a garment fabricating machine.

It is also desirable that the gap 60 have a width less than the width of the ribbon 12 to prevent the individual turns 14, when they shift axially outward into the gap 60 and the node 58 collapses, from moving any appreciable distance radially inward or outward from the layer of the roll 10 in which each turn 14 is wound. This prevents the entanglement of a turn 14 from one layer with the turns 14 of another layer during the shifting. Moreover, it is also desirable that the axial length of the drive roll 12 be such that the space between each axial end of the drive roll 10 and the axially inward side of an end cap 18 or 20 be less than the width of the gap 60. The end of the drive roll 10 thus will contain the ribbon turns 14 which slide into the gap 60 and ensure that they do not leak radially outward of the gap 60 and become entangled with other turns 14 as they are wound on the ribbon roll 12.

It will be understood that the foregoing description of the present invention is for purposes of illustration only and that the invention is susceptible to a number of modifications or changes, none of which entail any departure from the spirit and scope of the present invention as defined in the hereto appended claims.

What is claimed is:

1. In apparatus for winding elastomeric ribbon into a ribbon roll, the appratus being of the type including (i) a reel on which the ribbon roll is formed that has a rotatable shaft and spaced apart end caps, (ii) drive means for rotating the reel, and (iii) traverssing means for reversibly guiding the ribbon in directions parallel to the axial length of the reel to distribute the turns of the ribbon roll along the axial length of the reel with a gap between each end cap of the reel, and the ribbon the improvement wherein:

(1) the drive means includes a drive roll engaging the ribbon roll formed on the reel, the drive roll being positioned between the traversing means and the reel so that the elastomeric ribbon travels first across the traversing means, around the drive roll and thereafter onto the reel;

(2) pivotable means for supporting the shaft of the reel to pivot the ribbon roll into engagement with the drive roll for rotation thereof by the drive roll; and (3) guide means for guiding the elastomeric ribbon to the traversing means in an elongated condition;

the ribbon roll having a ribbon node at each of its axial ends, each ribbon node comprising at least one ribbon turn due to layering of ribbon turns while the traversing means is reversing the traverse direction of the ribbon; and each ribbon node being spaced a distance from the end cap to define the gap therebetween, said distance being sufficient to permit the turns of the ribbon node to slide into the gap such that said node collapses.

2. The apparatus of claim 1 wherein, subsequent to the sliding of the ribbon turns into the gap, the axial surface of the ribbon roll adjacent the end cap is substantially level with the axial surface of the ribbon roll remote from the end cap.

3. The apparatus of claim 1 wherein said distance is sufficient to permit the turns of the ribbon node to slide and the node to collapse only to a level eliminating the node.

4. The apparatus of claim 1 wherein said distance is less than the width of the ribbon.

5. The apparatus of claim 1 wherein the elonagation is at least 5% relative to the unelongated condition of the ribbon.

6. The apparatus of claim 1 wherein said drive roll has a pair of axial ends each positioned opposite and axially inward of an end cap of the reel and spaced a distance from the end cap less than the width of the ribbon.

7. A method of winding a roll of elastomeric ribbon onto a reel having spaced apart end caps comprising the steps of:

feeding the ribbon on to the reel between said end caps;

elongating the ribbon while it is fed to the reel;

while feeding the ribbon on to the reel, reversibly guiding the ribbon in directions parallel to the axal length of the reel to form the ribbon roll and distribute the turns of the ribbon roll along the axial length of the reel;

reversing the direction of movement of the ribbon parallel to the axial length of the reel before the ribbon engages an end cap to form a gap between the ribbon turns as wound and said end cap, the ribbon turns forming a node adjacent the gap during reversal of the direction of movement of the ribbon; and applying force to the ribbon roll with a rotatable roll to shift the ribbon turns forming the nodes adjacent said gap into the gap and to rotate the reel.

8. The method of claim 7 wherein the ribbon turns forming the node are shifted into the gap to a level substantially equal to the level of the most adjacent axial surface of the ribbon roll formed by ribbon turns which do not shift.

* * * * *